US005612645A

United States Patent [19]

Halepete

[11] Patent Number: 5,612,645

[45] Date of Patent: Mar. 18, 1997

[54] DYNAMIC MOSFET THRESHOLD VOLTAGE CONTROLLER

[75] Inventor: Sameer D. Halepete, Sunnyvale, Calif.

[73] Assignee: Sun Microsystems, Inc., Mountain View, Calif.

[21] Appl. No.: 566,020

[22] Filed: Dec. 1, 1995

[51] Int. Cl.[6] ..... G05F 1/10

[52] U.S. Cl. ..... 327/537; 327/543

[58] Field of Search ..... 327/534–543, 327/581, 77, 78, 87, 88, 89

[56] References Cited

U.S. PATENT DOCUMENTS

| | | | |
|---|---|---|---|
| 4,435,652 | 3/1984 | Stevens | 327/541 |
| 4,791,318 | 12/1988 | Lewis et al. | 327/581 |
| 5,461,338 | 10/1995 | Hirayama et al. | 327/538 |

OTHER PUBLICATIONS

Akira Yukawa, "A CMOS 8–Bit High–speed A/D Converter IC", IEEE Journal of Solid–State Circuits, vol. SC–20, No. 3, Jun. 1985, pp. 775–779.

*Primary Examiner*—Toan Tran
*Attorney, Agent, or Firm*—Limbach & Limbach L.L.P.

[57] ABSTRACT

A threshold voltage controller circuit for controlling the threshold voltage of complementary metal oxide semiconductor field effect transistors (CMOSFETs) integrated within an integrated circuit includes a test circuit, a clocked voltage comparator and voltage ramp generator. The test circuit simulates a critical signal path within the integrated circuit by receiving a first clock signal and providing in response thereto a corresponding delayed version of such clock signal. The clocked voltage comparator compares the voltage of the delayed clock signal output from the test circuit with a reference voltage and, in response to a second clock signal which is delayed with respect to the first clock signal, asserts a binary output signal high or low if the clock delay introduced by the test circuit is higher or lower, respectively, than desired. The voltage ramp generator, in response to the binary output signal from the clocked voltage comparator, generates an increasing or decreasing voltage ramp which is applied to the semiconductor substrate and well of the integrated circuit for increasing or decreasing the back bias thereto, thereby increasing or decreasing the threshold voltages of the CMOSFETs, respectively.

23 Claims, 5 Drawing Sheets

DYNAMIC MOSFET THRESHOLD VOLTAGE CONTROLLER

BACKGROUND OF THE INVENTION

1. Field of the Invention

The present invention relates to low power integrated circuits using complementary metal oxide semiconductor field effect transistors (CMOSFETs), and in particular, to low power integrated circuits which allow for some measure of control over the threshold voltage(s) of the CMOSFETs integrated therein.

2. Description of the Related Art

As the needs for and uses of portable, battery-operated computers and other types of systems become more varied and widespread, techniques for reducing the power consumption, both static and dynamic, of the digital integrated circuits used in such systems becomes increasingly important. One area of technology currently receiving much attention is that of chips using complementary metal oxide semiconductor field effect transistors (CMOSFETs).

However, even as advances are made with respect to reducing the power consumption of such chips, a number of areas continue to pose significant problems An example of one such area involves the dynamic power consumption of a typical CMOSFET chip due to the simultaneous requirements of a high operating speed, i.e. a high frequency clock signal, along with the ability to operate at reduced power supply voltages which necessitates the use of low threshold voltages for the CMOSFETs.

Therefore, it would be desirable to have a technique by which total power consumption (dynamic plus static) can be minimized while allowing for system operation at specified speed and power supply voltages(s).

SUMMARY OF THE INVENTION

A threshold voltage controller circuit for controlling the threshold voltage of complementary metal oxide semiconductor field effect transistors (CMOSFETs) integrated within an integrated circuit in accordance with the present invention provides for optimization of circuit power requirements at a specified operating speed. By using a simulation of a critical signal path within the integrated circuit, the power requirements of a portion of or the remainder of the circuitry within the integrated circuit can be reduced by controlling the transistor threshold voltage(s) while still maintaining an adequate circuit operating speed based upon the signal propagation delay through the simulated critical signal path.

An integrated circuit with a threshold voltage controller circuit for controlling the threshold voltage of complementary metal oxide semiconductor field effect transistors (CMOSFETs) integrated therein in accordance with one embodiment of the present invention includes a first semiconductor region of a first conductivity type, a second semiconductor region of a second conductivity type disposed within the first semiconductor region, a test circuit, a comparison circuit and a controller. The test circuit is for receiving a first clock signal and in response thereto providing a corresponding delayed clock signal. The test circuit includes CMOSFETs having a threshold voltage associated therewith, and the delayed clock signal is delayed with respect to the first clock signal by a response time period the duration of which is dependent upon such threshold voltage. The comparison circuit is coupled to the test circuit and is for receiving a reference voltage, the delayed clock signal and a second clock signal, comparing the reference voltage and delayed clock signal and, in accordance therewith and in response to the second clock signal, providing a comparison result signal. The second clock signal is delayed with respect to the first clock signal by a clock delay time period. The controller is coupled to the first and second semiconductor regions and comparison circuit and is for receiving the comparison result signal and in accordance therewith applying a control voltage across the first and second semiconductor regions for controlling the threshold voltage.

These and other features and advantages of the present invention will be understood upon consideration of the following detailed description of the invention and the accompanying drawings.

DETAILED DESCRIPTION OF THE INVENTION

The power consumed by a typical CMOSFET circuit can be described in terms of ac and dc components in accordance with the following:

$$P_{total}=P_{ac}+P_{dc}+P_{crowbar}=0.5*C*V^2*f+V*I_{static}+k*(Vdd-V_t)^3 \quad (1)$$

where C is the total effective capacitance of the circuit, V is the supply voltage, f is the frequency, $I_{static}$ is the static current and k is a constant factor which depends upon the rise time, clock period and the gain-factor of the MOS transistor. The threshold voltage $V_T$ of the transistors decides the values of all three of these components. The static current, which is the "off" current of the transistors, decreases exponentially with threshold voltage $V_t$ in accordance with the following:

$$I_{static}=I_o*10^{-Vt/s} \quad (2)$$

where $I_o$ is the current at $V_{gs}=V_t$, $V_t$ is the threshold voltage in volts and s is the subthreshold slope in volts/decade. Therefore, the higher the $V_t$, the lower the static current and, therefore, the static power dissipation which is $V_{dd}*I_{static}$.

The frequency of operation can be increased with decreasing threshold voltage as the gate drive increases. The signal propagation delay through a MOSFET can be approximated in accordance with the following:

$$T_d=c/(V_{dd}-V_t)^n \quad (3)$$

where $T_d$ is the circuit delay, n is a number between 1 and 2 that indicates the deviation from the MOSFET square law due to velocity saturation, and c is a constant that depends upon the load capacitance, drive current and supply voltage.

Figure 1A:
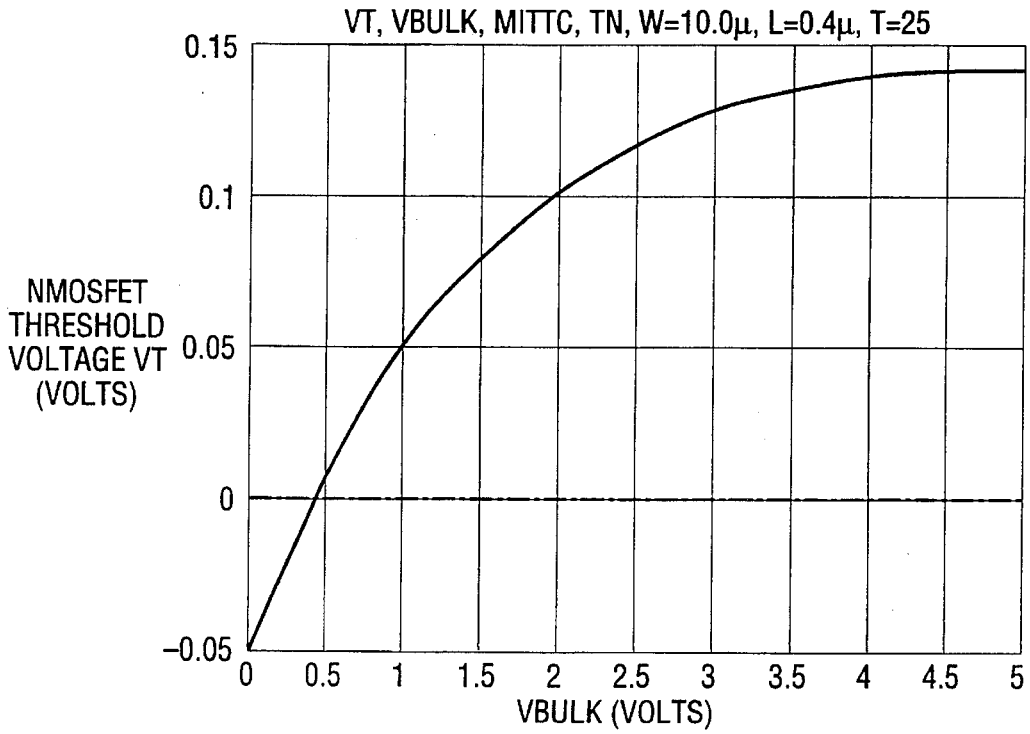
FIGS. 1A and 1B illustrate the effects upon threshold voltage due to back-bias voltages for NMOSFETs and PMOSFETs, respectively.
Figure 1B:
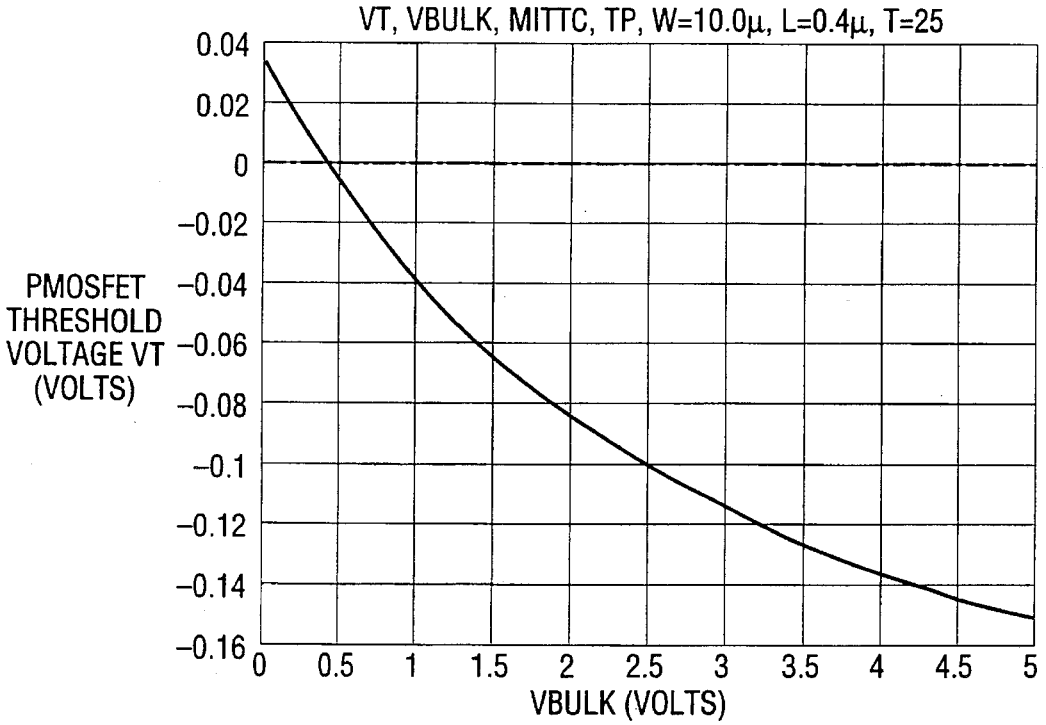

Referring to FIGS. 1A and 1B, the value of the threshold voltage $V_t$ can be changed by applying a voltage bias to the p-substrate/well and the n-well. As the back-bias is increased, the depletion width in the bulk is increased, thereby requiring that more voltage be applied to the gate to form a channel and, therefore, turn on the transistor. The reverse effect takes place as the back-bias is reduced. Therefore, it can be seen that the speed of the operation of the chip can be increased, but at the cost of higher static power dissipation by reducing the reverse-bias or by forward-biasing the n-well and p-substrate/well, and, conversely, static power dissipation can be decreased by reverse biasing the n-well and p-substrate/well, but at the cost of slower chip operation.

For example, in a chip fabricated in a low threshold voltage technology whose gate delays are shorter than they need to be (by virtue of its low threshold voltages) given its clock speed, the slowest signal settles down well before assertion of the clock has ended, i.e. well before de-assertion of the clock. This can happen in several situations, such as in the standby mode where the clock cycle is much longer than the delay of the circuit, or it can happen due to process and/or temperature variations which can lead to lower threshold voltages than otherwise normal. In such situations, more static and "crowbar" power will be dissipated than necessary just to keep the chip operating at the given clock speed. It would, therefore, be advantageous to have a circuit that can dynamically adjust the threshold voltage by adjusting the back-bias to meet a specified speed target at the lowest power.

Such a circuit would have to supply the required ac and dc current into the n-well and the p-substrate/well. This technique of threshold voltage $V_t$ control could produce undesired noise in the substrate and wells and could also forward bias the well and substrate. However, it has been found that at operation below 1 volt the substrate and well currents are in the micro-amp range and can be handled easily by a circuit in accordance with the present invention.

Figure 2:
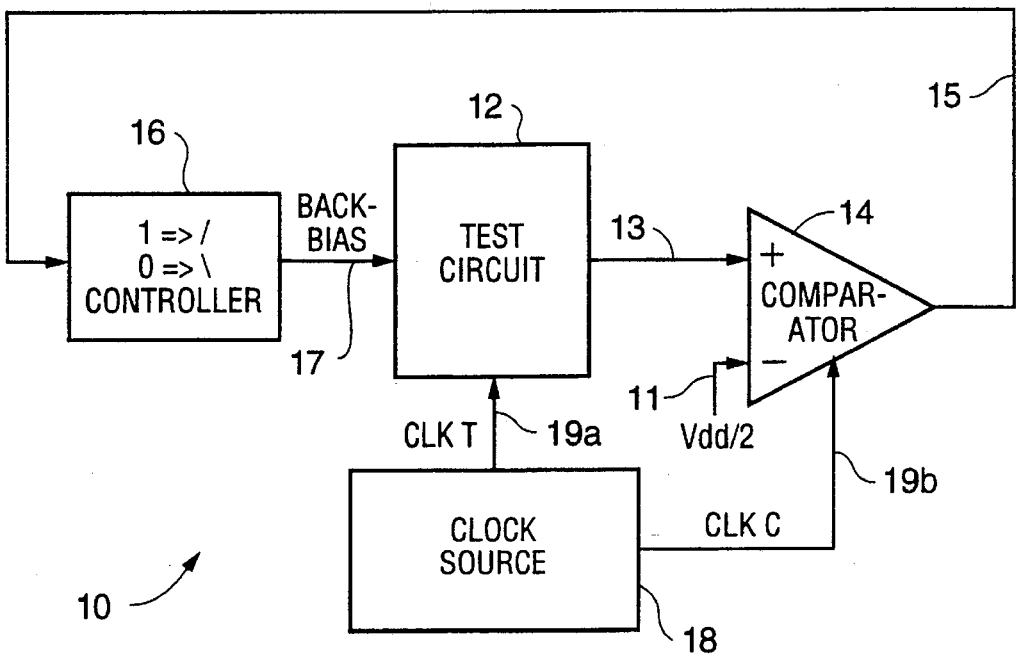
FIG. 2 is a functional block diagram of a threshold voltage controller circuit in accordance with one embodiment of the present invention.
Figure 4:
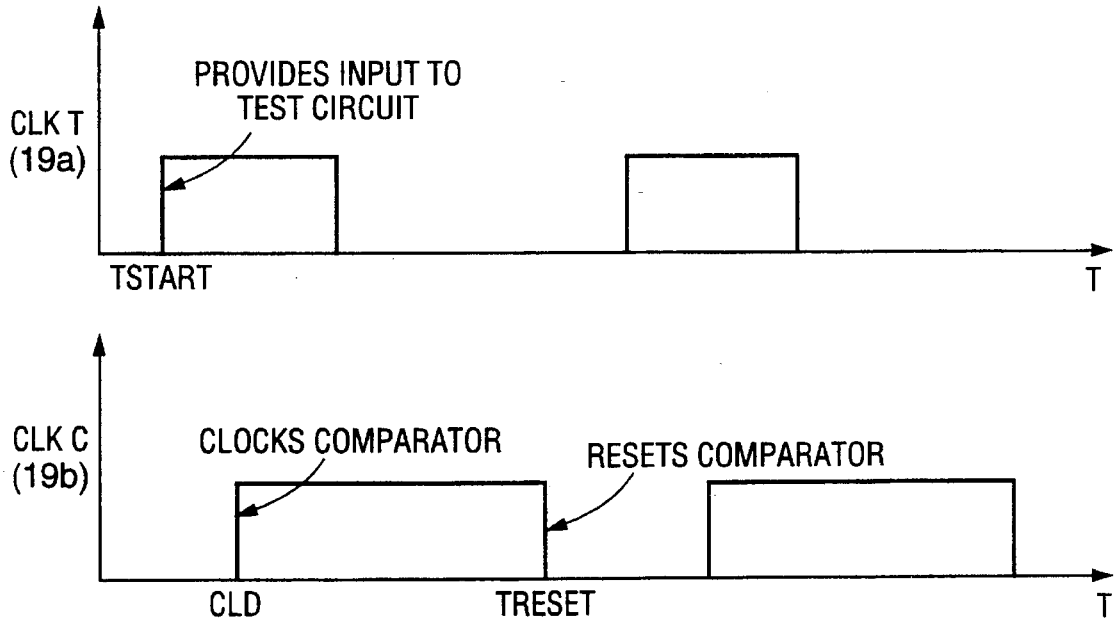
FIG. 4 is a timing diagram of the two input clock signals used by the threshold voltage controller circuit of FIG. 2.
Figure 3:
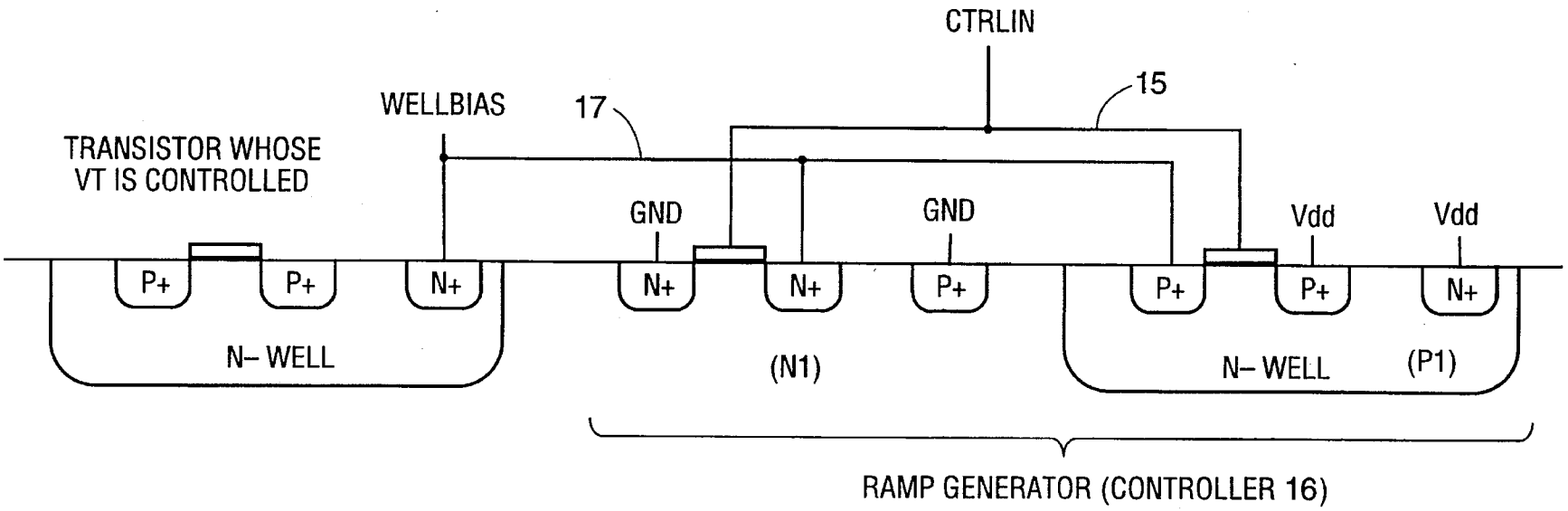
FIG. 3 is a cross-sectional view of an integrated circuit containing a threshold voltage controller circuit in accordance with the present invention.

Referring to FIG. 2, a threshold voltage controller circuit 10 in accordance with one embodiment of the present invention includes a test circuit 12, a comparison circuit (e.g. a clocked comparator) 14 and a controller (e.g. a voltage ramp generator) 16, all interconnected substantially as shown. Additionally, a clock source 18 is used to provide the necessary clock signals 19*a*, 19*b*. The test circuit 12 simulates the signal propagation delay of a critical signal path elsewhere within the chip and its dependence upon back-bias. Referring also to FIG. 3, this circuit is located within the well whose back-bias is being controlled. Referring also to FIG. 4, a clock 19*a* much slower than the system clock (e.g. with a rate approximately 1/100th that of the system clock) provides the test circuit 12 with an edge based upon which it makes its decision about the back-bias potential. For example, assume that the output 13 starts at a logic 0 and is supposed to go to a logic 1. This happens after a delay CPd. Suppose the clock 19*a* is set such that, for proper operation, the delay must be CLd. To determine whether the test circuit output 13 has settled to the correct value before CLd, the clocked comparator 14 is clocked by another clock signal 19*b* after CLd. One of its inputs 11 is a reference voltage equal to Vdd/2 while the other is the output 13 of the test circuit. Depending upon the output 15 of the comparator 14, the chip may be running too fast or too slow for the given system clock speed. Therefore, based upon the comparator output 15, the back-bias is increased (in the case of too fast operation) or decreased (in the case of too slow operation). This last operation is done by the controller 16 which generates a positive or negative going voltage ramp, depending upon whether the input is a logic 1 or a logic 0.

Figure 5:
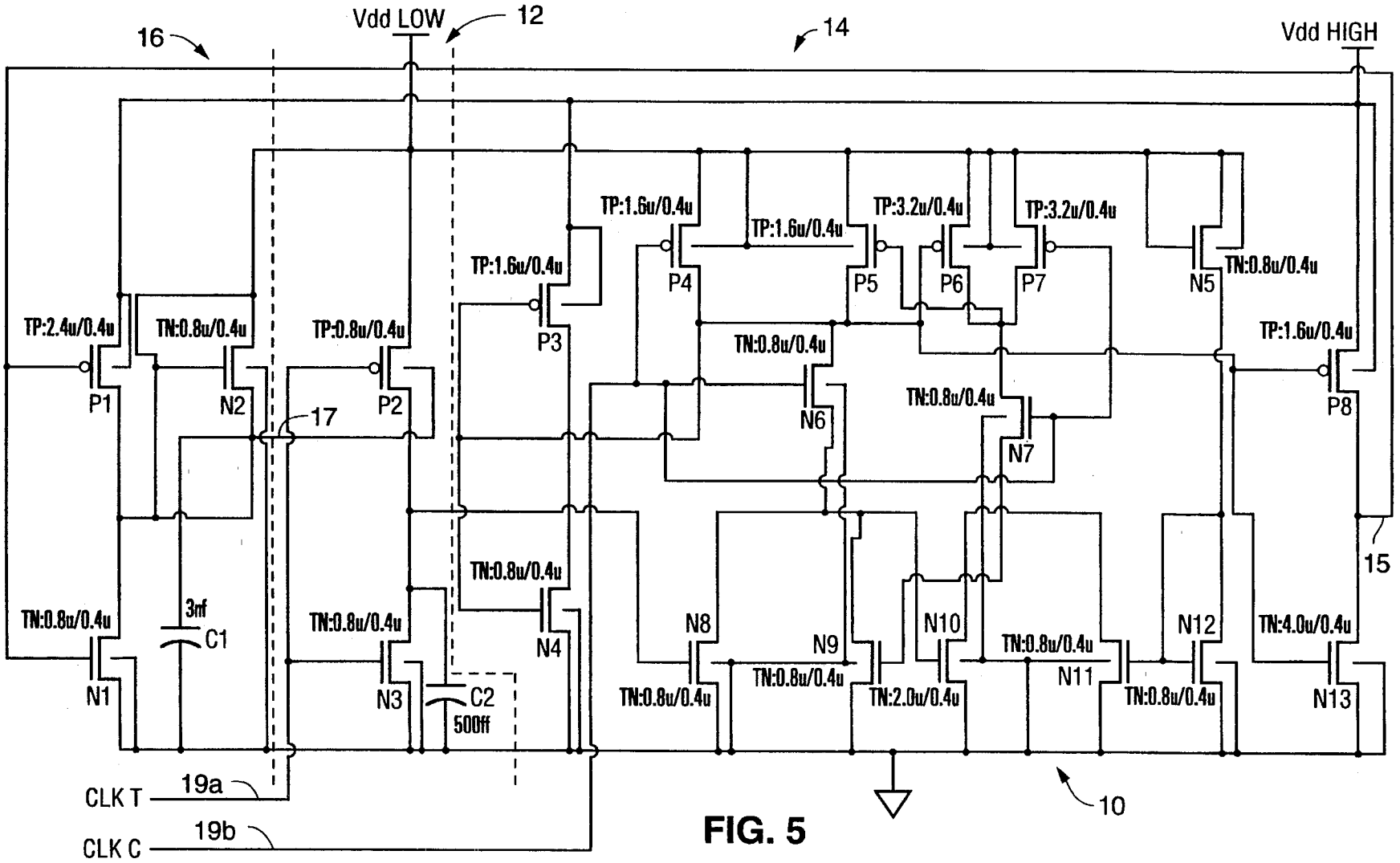
FIG. 5 is a circuit schematic diagram of one embodiment of the threshold voltage controller circuit of FIG. 2.

Referring to FIG. 5, one embodiment of the threshold voltage controller circuit 10 of FIG. 2 can be realized as shown. The circuit 10 uses two power supplies: a circuit supply VddLow set at 1 V; and a back-bias supply VddHigh set at 4 V (which can be generated using an on-chip charge pump). The value of VddHigh is determined by measuring the variation of threshold voltage versus back-bias. The back-bias supply voltage VddHigh should be that voltage up to which the threshold voltage $V_t$ changes significantly with a corresponding change in back-bias.

The test circuit 12 is a simple loaded (i.e. capacitively) inverter with a signal propagation delay equal to that of a critical signal path elsewhere within the chip. The controller 16 is a voltage ramp generator in the form of a heavily loaded (i.e. capacitively) ramp-limited inverter. When its input 15 is a logic high, NMOSFET N1 is turned on and discharges well/substrate capacitor C1. When the input 15 is a logic low, PMOSFET P1 is turned on and charges up capacitor C1. This circuit 16 also ensures that the n-wells charge-up to VddLow quickly enough so that they are not forward biased more than a couple of hundred millivolts. This is achieved by NMOSFET N2 which turns on hard when VddLow is high and the n-wells are at 0 V, and turns off when the n-well voltage goes above VddLow. (This transistor N2 must be sized large enough so that it follows VddLow closely.) The p-substrate/wells are already at circuit ground GND which means that they will not be forward-biased.

As noted above, the comparator 14 determines whether the test circuit 12 has settled in the given time period to the correct value. This is a conventional clocked comparator (such as that described in A. Yukawa, "A CMOS High-Speed A/D Converter IC", IEEE Journal of Solid-State Circuits, Vol. SC-20, No.3, June 1985, pp. 775–79) which has two inputs: a reference voltage equal to VddLow/2 which is generated by NMOSFETs N5 and N12 series-connected between VddLow and GND; and the output 13 of the test circuit 12. When the clock 19*b* is de-asserted, i.e. low, PMOSFETs P4 and P7 are turned on and NMOSFETs N6 and N7 are turned off, thereby causing the voltages across capacitors C1 and C2 to become equalized. When the clock 19*b* is asserted, i.e. high, NMOSFETs N6 and N7 are turned on and PMOSFETs P4 and P7 are turned off, resulting in two inverters being connected back-to-back as a latch and initiating a regenerative action which causes the latch to flip in a direction dictated by whether the input signal 13 voltage is higher or lower than the voltage with which it is being compared (i.e. VddLow/2). Hence, the output 15 settles to its final value quickly, in accordance with the input signal 13 voltage. The output 15 is also level-translated to VddHigh for driving the controller 16 which operates at VddHigh.

The clock source takes the internal clock of the chip as a reference and generates the clock signals 19*a*, 19*b* for the threshold voltage controller circuit 10 (as shown in FIG. 4). The delay between the rising edges of CLK T and CLK C is equal to a programmable delay the circuit is allowed to have, i.e. CLd. This delay (CLd) can be changed to program the threshold voltage controller circuit 10 to establish threshold voltages for different speeds of operation of the chip. This circuit 18 can be implemented using conventional digital dividers.

Figure 6A:
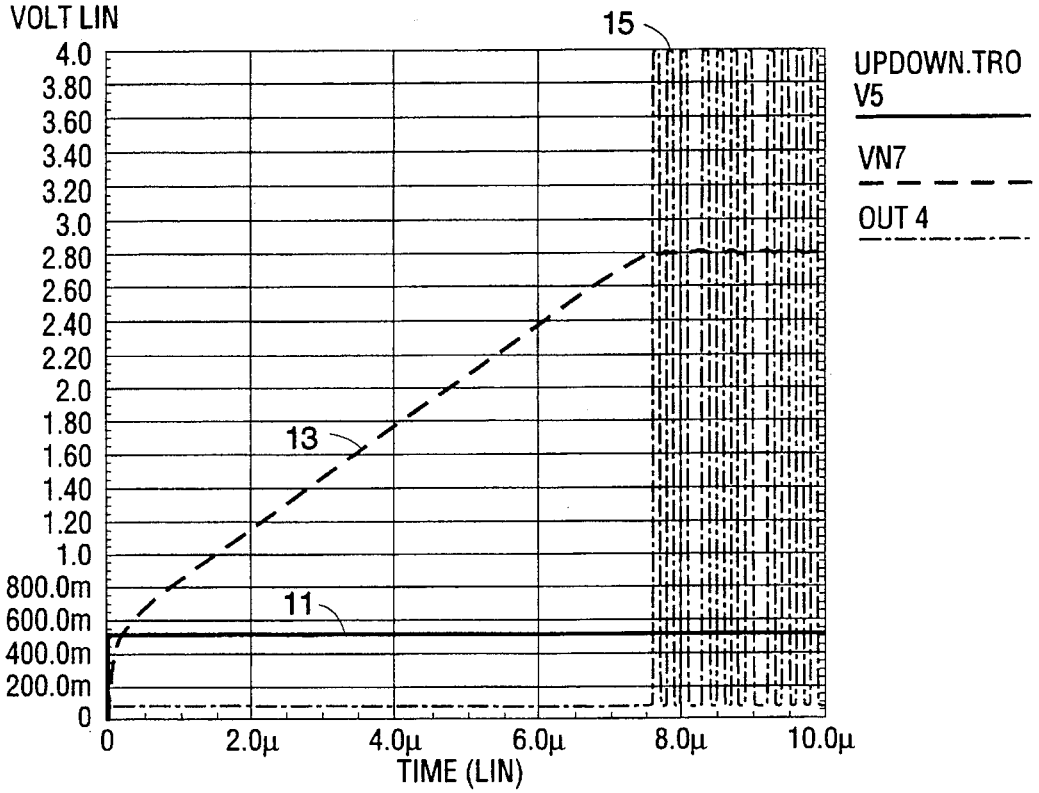
FIGS. 6A and 6B are timing diagrams of the bias control signal and back-bias voltage of the threshold voltage controller circuit of FIG. 5 for frequencies of operation at 125 MHz and 166 MHz, respectively.
Figure 6B:
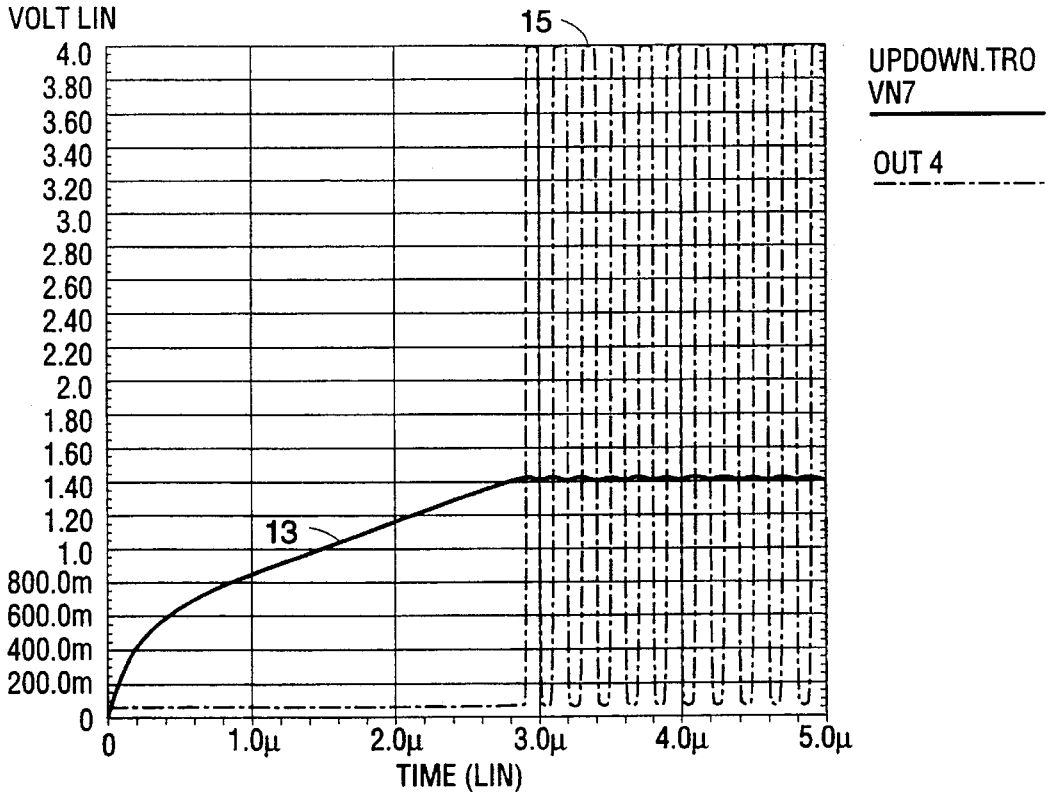

Referring to FIGS. 6A and 6B, the circuit 10 of FIG. 5 was simulated as a well-bias generator for the n-well with VddLow=1 V and VddHigh=4 V for well-bias generation. FIGS. 6A and 6B illustrate the well-bias generated by the circuit 10 at two different preprogrammed frequencies of operation of 125 MHz and 166 MHz, respectively. As can be seen, the well-bias increases up from a low voltage to its final value, with the initial increase being more rapid due to NMOSFET N2 which charges the n-well capacitor C1 through VddLow. The n-well voltage then oscillates somewhat around its final value as the circuit is on the edge of correct operation. The other signals shown are the VddLow/2 reference potential 11 generated by the transistor divider N5/N12 and the output 15 of the comparator 14 which decides whether the voltage ramp generator 16 goes up or down in voltage.

Referring to FIG. 6A, the first simulation was performed for a frequency of operation of 125 MHz, i.e. a clock period of 8 ns. The n-well bias settled at a voltage of 2.8 V. Referring to FIG. 6B, the second simulation was performed for a frequency of 166 MHz, i.e. a clock period of 6 ns. This provided a well-bias of 1.8 V. Therefore, in accordance with the foregoing discussion, a lower threshold voltage is required for a higher speed of operation.

It should be noted that the technique discussed above is perhaps better suited for use in a triple-well technology, where each transistor's well can be connected to either the power supply Vdd, circuit ground GND or the output of a back-bias generator. This can ensure that the back-bias generator is not causing feedback by controlling the substrate of its own transistors. (However, if the threshold voltage controller circuit 10 is on a separate chip this problem can be avoided. For example, the actual "control" circuitry, i.e. the comparator 14, controller 16 and clock source 18, can be located off-chip with respect to the test circuit 12.)

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a threshold voltage controller circuit for controlling the threshold voltage of a plurality of complementary metal oxide semiconductor field effect transistors (CMOSFETs) integrated within an integrated circuit, said threshold voltage controller circuit comprising:

a first semiconductor region of a first conductivity type;

a second semiconductor region of a second conductivity type disposed within said first semiconductor region;

a test circuit for receiving a first clock signal and in response thereto providing a corresponding delayed clock signal, wherein said test circuit includes a plurality of CMOSFETs having a threshold voltage associated therewith and disposed within said second semiconductor region, and wherein said delayed clock signal is delayed with respect to said first clock signal by a response time period the duration of which is dependent upon said threshold voltage;

a comparison circuit for receiving a reference voltage, said delayed clock signal from said test circuit and a second clock signal, comparing said reference voltage and said delayed clock signal and, in accordance therewith and in response to said second clock signal, providing a comparison result signal, wherein said second clock signal is delayed with respect to said first clock signal by a clock delay time period; and a controller for receiving said comparison result signal from said comparison circuit and in accordance therewith applying a control voltage across said first and second semiconductor regions for controlling said threshold voltage.

2. The apparatus of claim 1, wherein said first semiconductor region comprises a semiconductor substrate and said second semiconductor region comprises a semiconductor well.

3. The apparatus of claim 1, wherein said test circuit simulates a signal propagation delay through a circuit path within said threshold voltage controller circuit.

4. The apparatus of claim 1, wherein said comparison circuit comprises a clocked comparator.

5. The apparatus of claim 1, wherein said controller comprises a voltage ramp generator.

6. The apparatus of claim 1, further comprising a clock signal source for providing said first and second clock signals, wherein said clock delay time period is selectable.

7. The apparatus of claim 1, further comprising an integrated circuit into which said threshold voltage controller circuit is integrated.

8. The apparatus of claim 1, further comprising a computer into which said threshold voltage controller circuit is incorporated.

9. A method of providing an apparatus including a threshold voltage controller circuit for controlling the threshold voltage of a plurality of complementary metal oxide semiconductor field effect transistors (CMOSFETs) integrated within an integrated circuit, said method comprising the steps of:

providing a first semiconductor region of a first conductivity type;

providing a second semiconductor region of a second conductivity type disposed within said first semiconductor region;

providing a test circuit for receiving a first clock signal and in response thereto providing a corresponding delayed clock signal, wherein said test circuit includes a plurality of CMOSFETs having a threshold voltage associated therewith and disposed within said second semiconductor region, and wherein said delayed clock signal is delayed with respect to said first clock signal by a response time period the duration of which is dependent upon said threshold voltage;

providing a comparison circuit for receiving a reference voltage, said delayed clock signal from said test circuit and a second clock signal, comparing said reference voltage and said delayed clock signal and, in accordance therewith and in response to said second clock signal, providing a comparison result signal, wherein said second clock signal is delayed with respect to said first clock signal by a clock delay time period; and providing a controller for receiving said comparison result signal from said comparison circuit and in accordance therewith applying a control voltage across said first and second semiconductor regions for controlling said threshold voltage.

10. The method of claim 9, wherein said step of providing a first semiconductor region comprises providing a semiconductor substrate and said step of providing a second semiconductor region comprises providing a semiconductor well.

11. The method of claim 9, wherein said step of providing a test circuit comprises providing a simulation circuit which simulates a signal propagation delay through a circuit path within said threshold voltage controller circuit.

12. The method of claim 9, wherein said step of providing a comparison circuit comprises providing a clocked comparator.

13. The method of claim 9, wherein said step of providing a controller comprises providing a voltage ramp generator.

14. The method of claim 9, further comprising the step of providing a clock signal source for providing said first and second clock signals, wherein said clock delay time period is selectable.

15. The method of claim 9, further comprising the step of providing an integrated circuit into which said threshold voltage controller circuit is integrated.

16. The method of claim 9, further comprising the step of providing a computer into which said threshold voltage controller circuit is incorporated.

17. A method of controlling the threshold voltage of a plurality of complementary metal oxide semiconductor field effect transistors (CMOSFETs) integrated in an integrated circuit, said method comprising the steps of:

receiving a first clock signal and in response thereto providing a corresponding delayed clock signal with a test circuit, wherein said test circuit includes a plurality of CMOSFETs having a threshold voltage associated therewith, and wherein said delayed clock signal is delayed with respect to said first clock signal by a response time period the duration of which is dependent upon said threshold voltage;

receiving a reference voltage, said delayed clock signal and a second clock signal, comparing said reference voltage and said delayed clock signal and, in accordance therewith and in response to said second clock signal, providing a comparison result signal, wherein said second clock signal is delayed with respect to said first clock signal by a clock delay time period; and receiving said comparison result signal and in accordance therewith applying a control voltage across a first semiconductor region of a first conductivity type and a second semiconductor region of a second conductivity type disposed within said first semiconductor region for controlling said threshold voltage wherein said plurality of CMOSFETs is disposed within said second semiconductor region.

18. The method of claim 17, wherein said step of receiving a first clock signal and in response thereto providing a corresponding delayed clock signal with a test circuit is for simulating a signal propagation delay through a circuit path within said integrated circuit.

19. The method of claim 17, wherein said step of receiving said comparison result signal and in accordance therewith applying a control voltage across a first semiconductor region of a first conductivity type and a second semiconductor region of a second conductivity type disposed within said first semiconductor region for controlling said threshold voltage comprises generating and applying a voltage ramp as said control voltage.

20. The method of claim 17, wherein said step of receiving said comparison result signal and in accordance therewith applying a control voltage across a first semiconductor region of a first conductivity type and a second semiconductor region of a second conductivity type disposed within said first semiconductor region for controlling said threshold voltage comprises applying said control voltage across a semiconductor substrate and a semiconductor well, respectively.

21. The method of claim 17, further comprising the step of generating said first and second clock signals, wherein said clock delay time period is selectable.

22. The method of claim 17, further comprising the step of performing the recited steps within an integrated circuit.

23. The method of claim 17, further comprising the step of performing the recited steps within a computer.

* * * * *